United States Patent [19]

Thomson

[11] 4,186,978

[45] Feb. 5, 1980

[54] TILT DOWN RECEPTACLE FOR REFRIGERATOR DOOR

[75] Inventor: Eugene F. Thomson, Evansville, Ind.

[73] Assignee: Whirlpool Corporation, Benton Harbor, Mich.

[21] Appl. No.: 925,418

[22] Filed: Jul. 17, 1978

[51] Int. Cl.[2] ..... A47F 3/00; F25D 25/00

[52] U.S. Cl. ..... 312/138 A; 312/300; 211/80; 62/377

[58] Field of Search ..... 312/138 A, 248, 300, 312/270; 211/80; 62/89, 377, 337

[56] References Cited

U.S. PATENT DOCUMENTS

| | | | |
|---|---|---|---|
| 1,011,513 | 12/1911 | Spuhl | 211/80 |
| 1,125,182 | 1/1915 | Rupp | 211/80 |
| 1,292,329 | 1/1919 | Johnson | 211/80 |
| 1,485,496 | 3/1924 | Elliott | 312/300 |
| 2,012,262 | 8/1935 | Forsthoefel | 62/377 |
| 2,660,180 | 11/1953 | Endicott et al. | 312/270 |
| 2,694,906 | 11/1954 | Didion | 312/300 |
| 2,745,260 | 5/1956 | Saunders | 312/138 A |
| 2,808,310 | 10/1957 | Patterson, Jr. | 312/138 A |
| 2,894,378 | 7/1959 | Saunders et al. | 312/138 A |
| 2,944,410 | 7/1960 | Mann et al. | 312/138 A |

*Primary Examiner*—Victor N. Sakran

*Attorney, Agent, or Firm*—Wegner, Stellman, McCord, Wiles & Wood

[57] ABSTRACT

A refrigeration apparatus having a door wherein a food receptacle provided with a closure lid is mounted for selective positioning in a retracted position and in an access position. Positioning structure is provided for positioning the lid of the receptacle automatically away from the receptacle to permit access thereto as an incident of the user moving the receptacle to the access position. The receptacle is pivotally mounted to the door and the lid is pivotally mounted to the receptacle. The receptacle with the lid carried thereon may be removed from the refrigeration apparatus when desired.

8 Claims, 5 Drawing Figures

TILT DOWN RECEPTACLE FOR REFRIGERATOR DOOR

BACKGROUND OF THE INVENTION

1. Field of the Invention

This invention relates to refrigeration apparatus and in particular to the mounting of receptacles within the refrigerated space of a refrigeration apparatus.

2. Description of the Prior Art

A number of prior art structures have been developed for pivotally mounting a receptacle to the inner door of a refrigeration apparatus. In a number of these prior art structures, the receptacle is closed by a lid across the top opening of the receptacle, which lid must be manually removed to provide access to the interior of the receptacle after it is brought to the accessible position. Further, in a number of prior art structures, the receptacle is movably carried on the door so as to be selectively disposed in a retracted position within the door and an access position wherein the receptacle projects outwardly from the inner door.

More specifically, Gregg F. Forsthoefel, in U.S. Pat. No. 2,012,262, shows a refrigeration apparatus wherein a receptacle is pivotally mounted to the door and wherein a cover is connected to the door by a link and to the receptacle by a pivot so that when the cover is pivoted upwardly to expose the upper opening of the receptacle, the receptacle is concurrently tilted away from the door.

In U.S. Pat. No. 2,694,906, Nolan A. Didion shows a refrigeration apparatus wherein a receptacle is pivotally mounted to the door for movement between a retracted position in the door and an access position projecting rearwardly from the door. Access to the interior of the receptacle through the top opening thereof in the access position is obtained by releasing the spring latches locking the lid to the receptacle and permitting the user to then raise the lid by pivoting it about its pivotal connection to the receptacle.

Orson V. Saunders, in U.S. Pat. No. 2,745,260, shows a hydrator mounted on a refrigerator door wherein the cover of the hydrator is pivotally mounted to a fixed rear portion of the structure so as to be swung down from the vertical retracted position to the horizontal access position with the cover effectively defining a hollow upwardly opening receptacle in the horizontal position.

Orson V. Saunders et al, in U.S. Pat. No. 2,894,378, show a refrigeration apparatus wherein the receptacle is pivotally mounted to the door to swing downwardly to a horizontal position and, similarly to the Didion patent discussed above, requires that the cover then be unlatched so as to be manually moved to an open position to provide access to the interior of the receptacle in the access position.

SUMMARY OF THE INVENTION

The present invention comprehends an improved refrigeration apparatus wherein a receptacle is movably mounted to a portion of the wall of the refrigeration apparatus and when moved from a retracted position on the wall means to an access position, causes an automatic removal of the cover at a position intermediate the retracted and access positions so as to prevent spillage of objects from the receptacle during the movement to the access position.

In the illustrated embodiment, the receptacle is pivotally mounted to the door of the refrigeration apparatus so as to be disposed in a substantially vertical disposition in the retracted arrangement, and specifically, may be mounted to the door so as to be received in a recess thereof in the retracted position. In swinging downwardly on the pivot mounting means to the substantially horizontal access position, the lid is maintained in closed relationship to the receptacle until the receptacle reaches a predetermined intermediate position. In the illustrated embodiment, the intermediate position is approximately 45° and, thus, the lid is maintained in closed relationship to the receptacle until the receptacle swings beyond the 45° position and thereby effectively prevents spillage from the receptacle during the movement thereof.

In the illustrated embodiment, the receptacle is pivotally mounted to the door and the lid is pivotally mounted to the receptacle. A cooperating track and guide means are provided on the door and lid so as to effect the desired raising of the lid relative to the receptacle at the 45° position, as discussed above. In the specific embodiment illustrated, a guide track is mounted on the door and a follower is provided on the lid for engaging the guide track in effecting the desired selective positioning of the lid relative to the receptacle.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
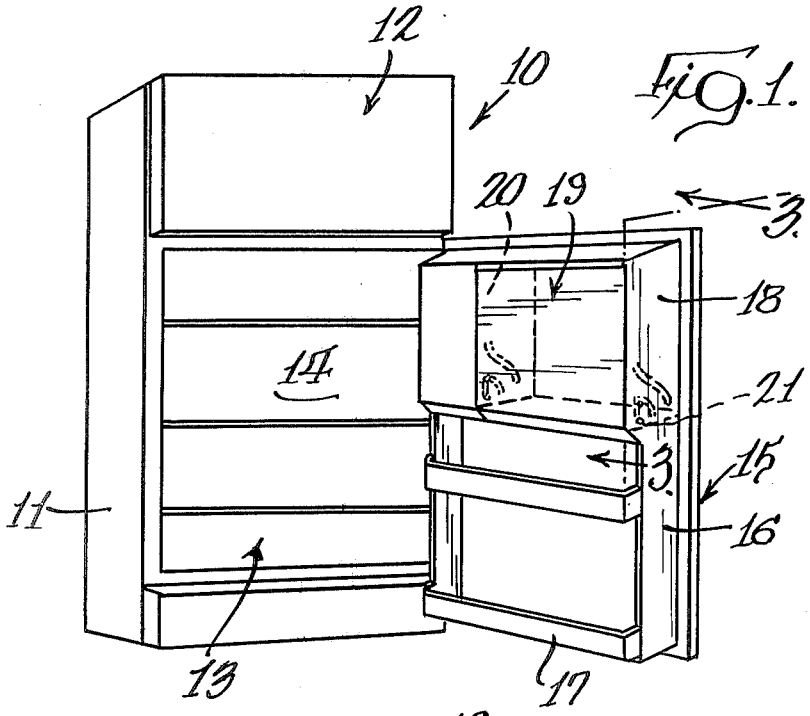
FIG. 1 is a perspective view of a refrigeration apparatus having an improved storage receptacle means embodying the invention.

In the exemplary embodiment of the invention as disclosed in the drawing, a refrigeration apparatus generally designated 10 is shown to comprise a freezer-refrigerator apparatus having a cabinet 11 defining an upper freezer portion generally designated 12 and a lower above-freezing refrigeration portion 13. The refrigeration portion 13 is defined by a portion of the cabinet 11 forming a refrigeration space 14 selectively closed by a door 15. The door is provided with an inner liner 16 defining a plurality of shelves 17 and an upper hollow inwardly projecting portion 18 provided with a tilt down receptacle generally designated 19, which illustratively may comprise a fresh food storage receptacle.

Figure 5:
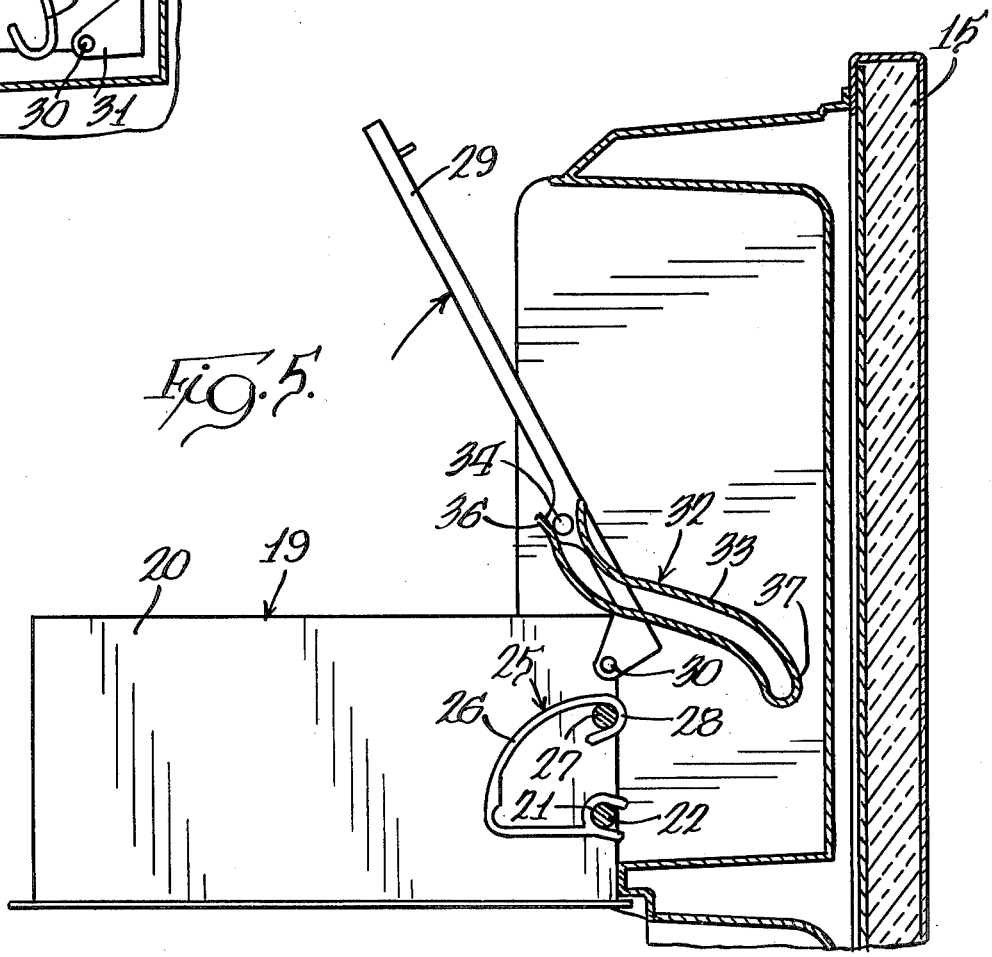
FIG. 5 is a fragmentary vertical section similar to that of FIG. 4, but with the receptacle in the horizontal access position and with the lid retained in the intermediate position.

In broad aspect, the receptacle is movably mounted to the wall means defining the outer portion of the refrigeration apparatus, door 15 comprising a movable portion of the wall means. The receptacle projects into the refrigeration space 14 and, thus, is cooled by the refrigeration means. As illustrated in full lines in FIG. 1, the receptacle may be stored within the door portion 18 in a substantially vertical retracted, or storage, position, and may be brought to a generally horizontally extending access position, as shown in FIG. 5, wherein objects, such as fresh food, may be placed in or removed from the receptacle as desired. The invention is concerned with an improved means for removably mounting the receptacle to the wall means portion defined by the door so as to provide an improved spillage-free movement between the access and storage positions.

Figure 2:
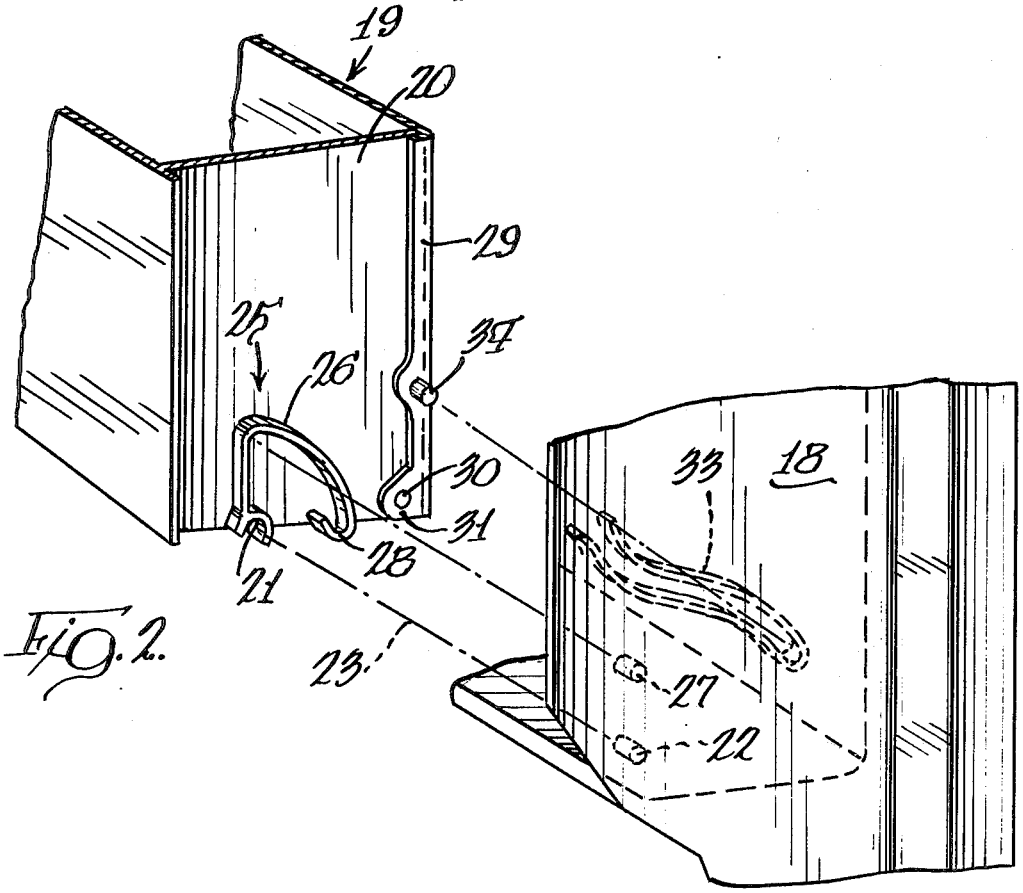
FIG. 2 is a fragmentary exploded perspective view illustrating the means for mounting the receptacle pivotally to the refrigeration apparatus door and the lid pivotally to the receptacle, and the means for effecting relative movement between the lid and receptacle at the intermediate position.

As shown in FIGS. 1 and 2, the opposite sidewalls 20 of the receptacle are provided with first pivot means 21 cooperating with complementary second pivot means 22 on the door portion 18 effectively defining a horizontal pivot axis 23 at the lower front portion of the receptacle when the receptacle is in the vertical storage position of FIG. 1.

The receptacle and door are further provided at each of the sidewalls 20 with cooperating pivot limiting means generally designated 25, including a first portion 26 carried on the receptacle sidewalls 20 and a cooperating portion 27 carried on the door portion 18.

Figure 3:
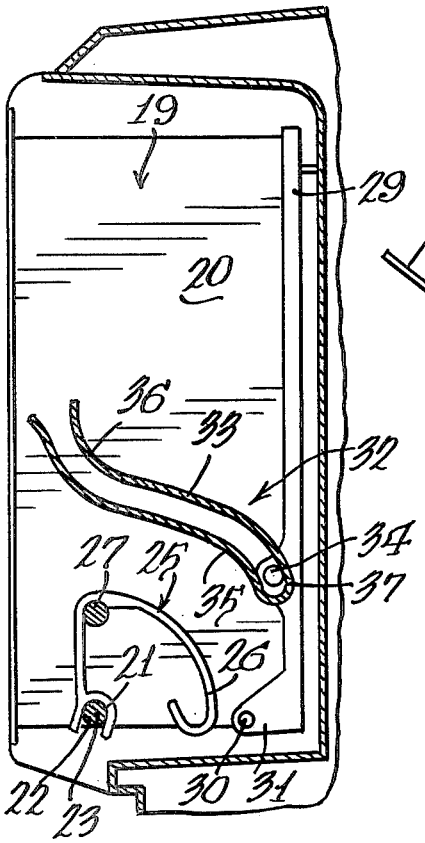
FIG. 3 is a fragmentary enlarged vertical section taken substantially along the line 3—3 of FIG. 1.
Figure 4:
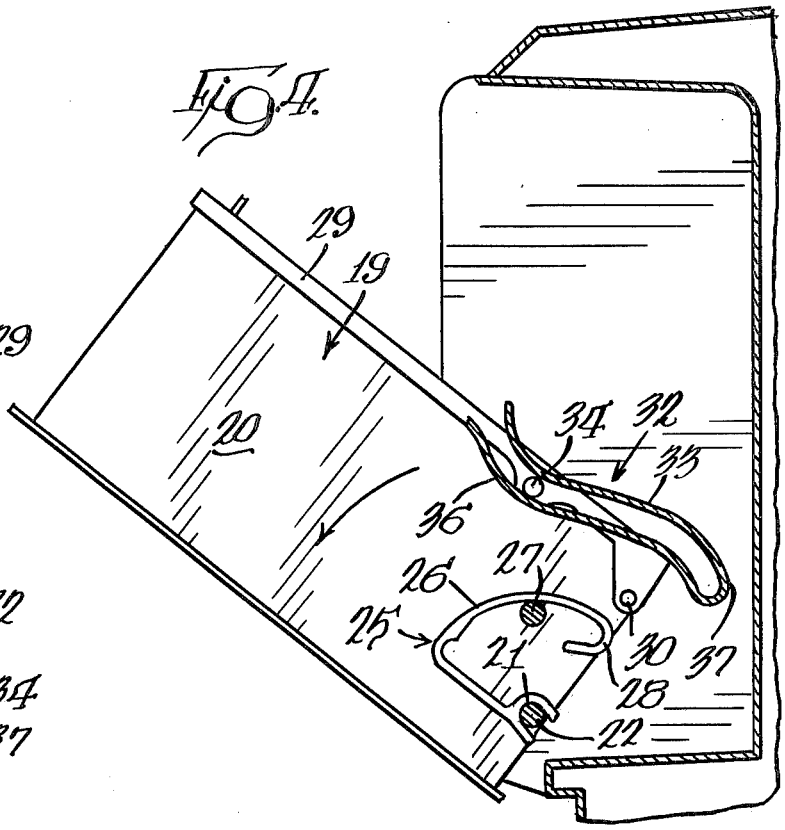
FIG. 4 is a fragmentary vertical section similar to that of FIG. 3, but with the receptacle disposed approximately at the intermediate position.

In the illustrated embodiment and as best seen in FIG. 2, the first pivot means 21 may comprise semicylindrical or U-shaped bearings and the second pivot means 22 may comprise pivot pins pivotally received in the bearings 21 for movably pivotally supporting the receptacle in the manner illustrated in FIGS. 3, 4 and 5. The first pivot limiting means 26 may comprise guides carried on the sidewalls 20 of the receptacle and the second pivot limiting means 27 may comprise pins carried on the door wall portion 18 and slidably engaging the guides 26. The guides may include a turned distal end portion 28 which effectively limits the downward pivoting movement of the receptacle by limiting the movement of the pins 27 along the guides to a position wherein the receptacle is in a generally horizontally extending access position, as seen in FIG. 5. As can be further seen in FIG. 5, the receptacle 19 may be readily removed from the door when desired as a result of the open arrangement of the turned distal portion 28 and the U-shaped pivot means 21.

The present invention comprehends an improved means for preventing spillage of objects, such as fresh food and the like, retained within the receptacle 19 while yet providing automatic facilitated access to the interior of the receptacle in the access position of FIG. 5. More specifically, the invention comprehends providing a lid 29 which is pivotally mounted to the sidewalls 20 of the receptacle by suitable pivot pins 30 carried on inturned flanges 31 of the lid outwardly of the sidewalls 20 at the opposite sides of the receptacle. The pins 30 may be received in suitable openings in the sidewalls to provide a relative pivotal movement between the lid and receptacle at the lower rear portion of the sidewalls, as shown in FIG. 2. Thus, the lid 29 is pivotally mounted to the receptacle so as to be swung upwardly to permit access to the interior of the receptacle once the receptacle is brought to the horizontal access position of FIG. 5.

To effect such upward positioning of the lid relative to the receptacle automatically as a result of the downward tilting of the receptacle from the retracted position of FIG. 3 to the access position of FIG. 5, positioning means generally designated 32 are provided. More specifically, the positioning means include track-type guides 33 carried on the door portion 18 and follower pins 34 carried on the lid flanges 31. As seen in FIGS. 3–5, the track guides are curved so as to include a first portion 35 which is generally arcuate about the axis 23 of the receptacle hinge pins 22, and a second portion 36 which extends away from the axis 23.

In the vertical retracted storage position of the receptacle as shown in FIG. 3, the follower pins 34 are received in the innermost end 37 of the track guide which may be turned downwardly to extend generally chordally to the arcuate portion 35 and, thus, automatically provide a limited restraining force on the downward pivotal movement of the receptacle and effectively retaining the receptacle lid 29 in a closed storage position until such time as it is desired to move the receptacle therefrom to the access position of FIG. 5.

As the receptacle is manually pivoted about the pins 22 from the retracted position of FIG. 3, the pins 27 move along the pivot limiting means portion 26 and the follower pins 34 move through the arcuate portion 35 of the track guide 33 to permit free pivoting of the receptacle to an intermediate position of approximately 45° to the horizontal, as shown in FIG. 4. During this movement of the receptacle, the lid 29 is maintained closed across the top of the receptacle, thereby preventing spillage of any food products and the like within the receptacle during such movement. In the illustrated embodiment, the movement of the receptacle to the intermediate position may be slightly over 45° and, illustratively, may comprise an angle of approximately 51° from the vertical.

As the receptacle is swung further away from the door 15 to the access position of FIG. 5 from the intermediate position of FIG. 4, the guide follower pins 34 are moved into the end portion 36 of the track guide 33, thus causing the lid 29 to be pivoted on pins 30 away from the receptacle. Due to the curved end portion 36 of track 33 and the arcuate movement of the pivot pins 30 as the receptacle 19 is pivoted toward the access position, lid 29 is caused to pivot in the direction opposite to that of the receptacle during the last portion of the receptacle's movement to the access position. Thus, as seen in FIG. 5, when the receptacle is brought fully to the horizontal access position controlled by the abutment of pins 27 with the turned end 28 of the pivot limiting means 25, the upwardly held lid assumes an angle of less than 45° from the vertical. This permits ready and complete access to the interior of the receptacle, such as for removing or placing fresh food objects and the like therein.

When it is desired to restore the receptacle to the storage position of FIG. 3, the user merely pivots the receptacle on the receptacle supporting pins 22, causing the receptacle to pivot upwardly to the intermediate position of FIG. 4 and concurrently causing the lid pins 34 to move downwardly through the track guide 33 whereupon the relative movement between the receptacle and lid effects a closing of the receptacle by the lid, as shown in FIG. 4.

Continuing upward pivoting of the receptacle with the lid 29 now closing the receptacle may be effected until the receptacle is fully received within the door portion 18 in the retracted storage position of FIG. 3.

Thus, the invention comprehends an improved cooperating mounting means for the receptacle and closure lid therefor, whereby selective positioning of the receptacle in storage and access positions concurrently automatically effects an improved movement of the lid relative to the receptacle so as to effectively prevent spillage of food objects and the like from the receptacle during the movement while yet assuring full access to the receptacle when the receptacle is disposed in the access position. The invention is illustrated in connection with the mounting of the receptacle on the liner of the refrigeration apparatus door, it being obvious to those skilled in the art that other suitable positions of the receptacle relative to the mounting wall means may be utilized within the scope of the invention.

As will be further obvious to those skilled in the art, the track guide portion 36 may be suitably arranged so as to retain the lid 29 at any suitable angle when the receptacle is brought fully to the access position of FIG. 5.

Further as will be obvious to those skilled in the art, the invention broadly comprehends the provision of any suitable means for movably mounting the receptacle to the wall means for movement between the retracted and access positions thereof.

The improved simplified structure provided for effecting the improved control of the lid positioning is economical of construction while yet providing the highly desirable control.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having wall means defining a refrigerated space, an opening to said space, and a door for selectively closing said opening, a receptacle in said space defining an access opening, and a lid pivotally mounted to said receptacle for selectively closing said receptacle opening, improved means for movably mounting said receptacle and lid in said space comprising:

mounting means for pivotally mounting said receptacle in said door for movement between a vertical retracted position therein and a horizontal access position projecting outwardly from the door with said access opening uppermost, said mounting means defining a horizontal pivot axis at the bottom of said receptacle when said receptacle is in said vertical position;

a follower pin carried by said lid and extending therefrom in a direction generally parallel to said pivot axis;

a guide carried by said door adjacent said follower for contacting and guiding the movement of said follower as an incident of movement of said receptacle, said guide having a first portion which is generally arcuate about said pivot axis for guiding said follower as said receptacle is moved between said retracted position and an intermediate position such that said lid remains closed, and a second portion which extends away from said pivot axis for guiding said follower as said receptacle is moved between said intermediate position and said access position such that said lid is thereby moved to an open position providing access to said receptacle opening.

2. In a refrigeration apparatus having wall means defining a refrigerated space having an opening to said space and a door for selectively closing said opening, a receptacle in said space defining an access opening, and a lid pivotally mounted to said receptacle for selectively closing said receptacle opening, improved means for movably mounting said receptacle and lid in said space comprising:

mounting means for pivotally mounting said receptacle in said wall means for movement between a retracted position therein and an access position projecting outwardly from the wall means with said access opening uppermost, said mounting means defining a horizontal pivot axis at the bottom of said receptacle when said receptacle is in said vertical position;

a follower carried by said lid and extending therefrom in a direction generally parallel to said pivot axis;

a guide carried by said wall means adjacent said follower for contacting and guiding the movement of said follower as an incident of movement of said receptacle, said guide having a first portion which is generally arcuate about said pivot axis for guiding said follower as said receptacle is moved between said retracted position and an intermediate position such that said lid remains closed, and a second portion which extends away from said pivot axis for guiding said follower as said receptacle is moved between said intermediate position and said access position such that said lid is thereby moved to an open position providing access to said receptacle opening.

3. The refrigeration apparatus structure of claim 2 wherein said wall means defines a door and said mounting means movably mounts said receptacle to said door.

4. The refrigeration apparatus structure of claim 2 wherein said receptacle is disposed in a vertically extended arrangement in said retracted position and in a horizontally extended arrangement in said access position.

5. The refrigeration apparatus structure of claim 2 wherein said receptacle is disposed in a vertically extended arrangement in said retracted position and in a horizontally extended arrangement in said access position, and said lid is disposed by said positioning means in an angularly tilted arrangement when said receptacle is positioned in said access position.

6. The refrigeration apparatus structure of claim 2 wherein said receptacle is disposed in a vertically extended arrangement in said retracted position and in a horizontally extended arrangement in said access position, and said lid is maintained across said access opening by said positioning means until said receptacle is moved away from said retracted position beyond a predetermined angular position intermediate said retracted and access positions.

7. The refrigeration apparatus structure of claim 2 wherein said guide is arranged to retain said lid at at least a 45° angle to the horizontal above said receptacle when said receptacle is disposed in said access position.

8. The refrigeration apparatus structure of claim 2 wherein said guide comprises a track on said wall means.

* * * * *